US005361868A

United States Patent [19]

Bartos

[11] Patent Number: 5,361,868

[45] Date of Patent: Nov. 8, 1994

[54] STEP LADDER BOOT KIT

[76] Inventor: Agnes M. Bartos, R.D. 1 Evergreen Rd., Pulaski, Pa. 16143

[21] Appl. No.: 164,534

[22] Filed: Dec. 10, 1993

[51] Int. Cl.[5] ..... E06C 7/44

[52] U.S. Cl. ..... 182/111; 248/188.9

[58] Field of Search ..... 182/107-111, 182/165, 214; 248/188.9

[56] References Cited

U.S. PATENT DOCUMENTS

| | | | |
|---|---|---|---|
| 1,563,700 | 12/1925 | Frankenstein | 182/111 |
| 1,570,576 | 1/1926 | Rivitz | 182/111 |
| 2,680,354 | 6/1954 | Dakin | 182/214 |
| 3,213,963 | 10/1965 | Vogt | 182/111 |

*Primary Examiner*—Alvin C. Chin-Shue
*Attorney, Agent, or Firm*—Hugh E. Smith

[57] ABSTRACT

A stabilizer system for a step ladder which comprises a set of four rigid boots adapted to be mounted one on each leg of the ladder. The boots each have a large flat plate forming the support base and are pivotally mounted on each leg so as to be self-leveling. When in place they will prevent the ladder legs from sinking into a soft surface and may be provided with a non-skid covering and a toothed surface for use on hard surfaces or slippery surfaces such as mud or ice.

1 Claim, 4 Drawing Sheets

FIG. 1
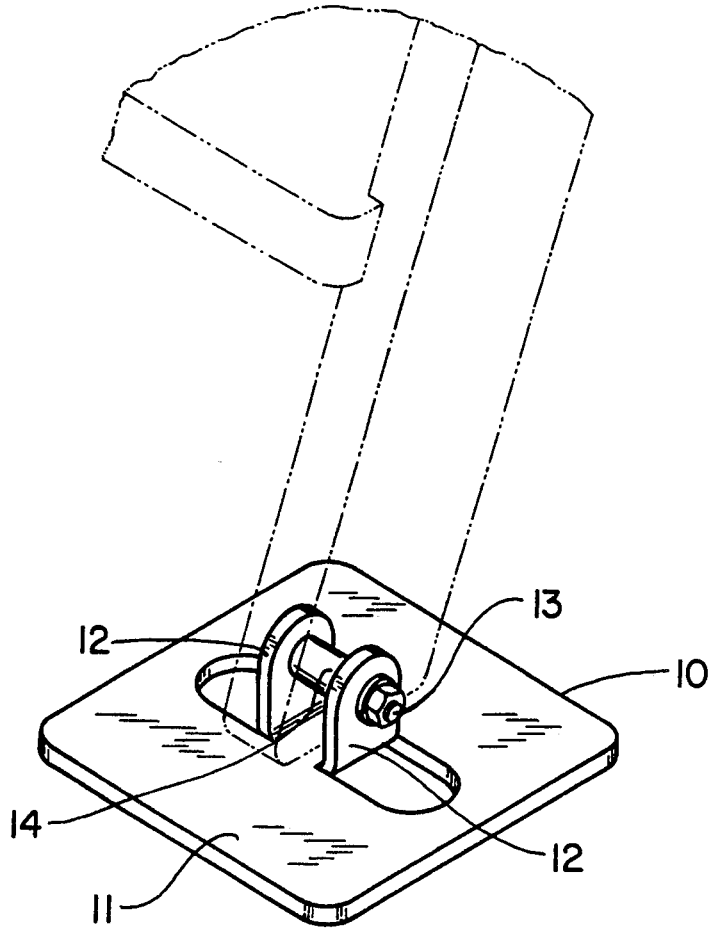
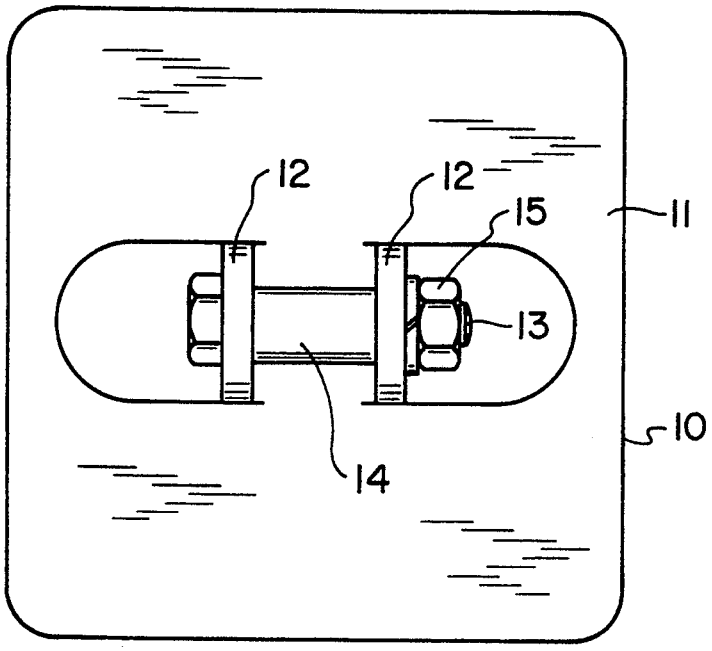
FIG. 2

FIG. 3
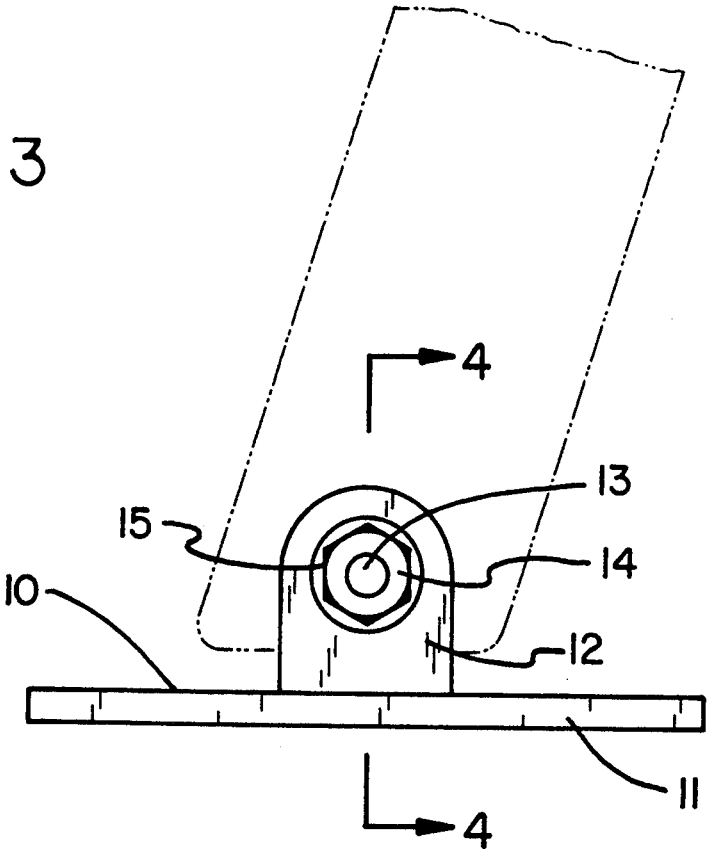
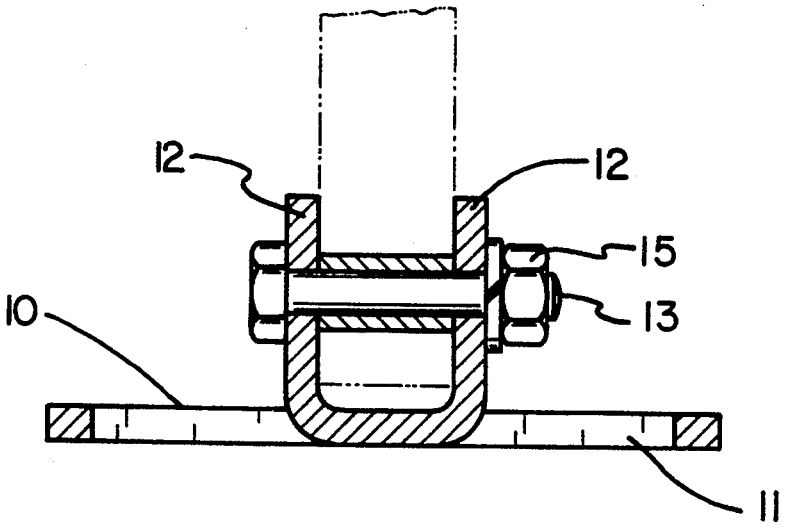
FIG. 4

FIG. 5
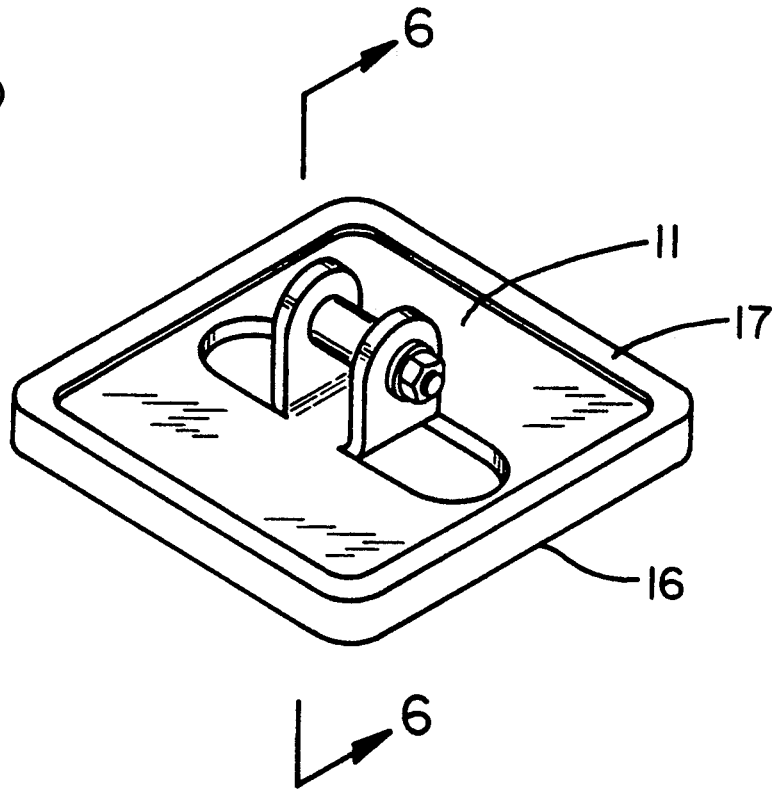
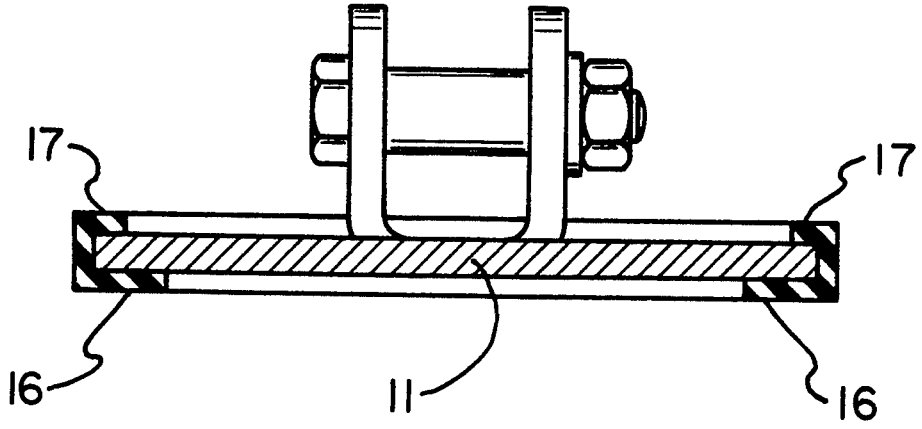
FIG. 6

STEP LADDER BOOT KIT

BACKGROUND OF THE INVENTION

1. Field of the Invention

The present invention relates to step ladder attachments and more particularly pertains to such ladders which may be stabilized against tipping or sinking into soft ground.

2. Description of the Prior Art

The use of ladder stabilizers are is known in the prior art. More specifically, devices heretofore devised and utilized for the purpose of stabilizing ladders are known to consist basically of familiar, expected and obvious structural configurations, notwithstanding the myriad of designs encompassed by the crowded prior art which have been developed for the fulfillment of countless objectives and requirements. Typical prior art related to this concept is shown in U.S. Pat. Nos. 4,415,062; 3,805,917 and 4,496,025.

In this respect, the step ladder attachment according to the present invention substantially departs from the conventional concepts and designs of the prior art, and in so doing provides an easily added accessory kit primarily developed for the purpose of stabilizing a step ladder.

Therefore, it can be appreciated that there exists a continuing need for new and improved stabilizers which can be used with step ladders. In this regard, the present invention substantially fulfills this need.

SUMMARY OF THE INVENTION

In view of the foregoing disadvantages inherent in the known types of ladder stabilizers now present in the prior art, the present invention provides an improved kit construction wherein the same can be utilized for easy addition to any step ladder. As such, the general purpose of the present invention, which will be described subsequently in greater detail, is to provide a new and improved step ladder boot kit which has all the advantages of the prior art device and none of the disadvantages.

To attain this, the present invention essentially relates to a stabilizer system for a step ladder which comprises a set of four rigid boots adapted to be mounted one on each leg of the ladder. The boots each have a large flat plate forming the support base and are pivotally mounted on each leg so as to be self-leveling. When in place they will prevent the ladder legs from sinking into a soft surface and may be provided with a non-skid covering and a toothed surface for use on hard surfaces or slippery surfaces such as mud or ice.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stabilizer kit for step ladders which has all the advantages of the prior art devices and none of the disadvantages.

It is another object of the present invention to provide a new and improved step ladder boot kit which may be easily and efficiently manufactured and marketed.

It is a further object of the present invention to provide a new and improved step ladder boot kit which is of a durable and reliable construction.

An even further object of the present invention is to provide a new and improved step ladder boot kit which is susceptible of a low cost of manufacture with regard to both materials and labor, and which accordingly is then susceptible of low prices of sale to the consuming public, thereby making such kits economically available to the buying public.

Still another object of the present invention is to provide a new and improved kit which is easily attachable to any step ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of one of the boots of the kit of the present invention in place on a step ladder leg.

FIG. 2 is a top plan view of the boot shown in FIG. 1.

FIG. 3 is a side elevation of the boot shown in FIG. 1.

FIG. 4 is a front elevation of the boot shown in FIG. 1.

FIG. 5 is a perspective view of the boot of FIG. 1 showing a modification thereon.

FIG. 6 is a sectional view on line 6—6 of FIG. 5.

DESCRIPTION OF THE PREFERRED EMBODIMENT

Figure 7:
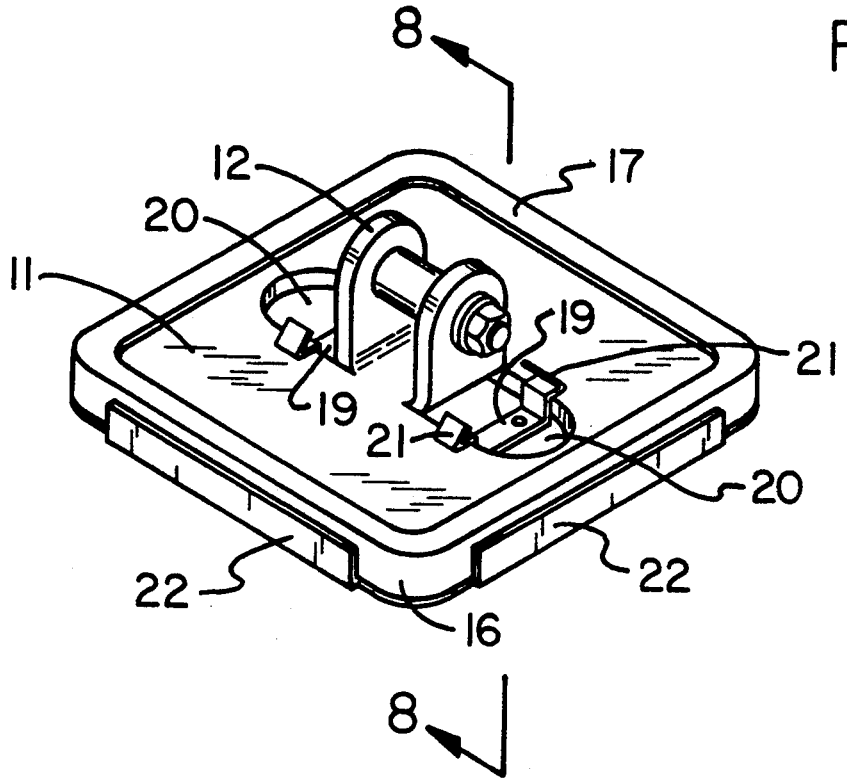
FIG. 7 is a perspective view of the boot of FIG. 1 with a further modification added.

With reference now to the drawings, and in particular to FIGS. 1 and 2 thereof, a new and improved ladder boot embodying the principles and concepts of the present invention and generally designated by the reference numeral 10 will be described.

More specifically, it will be noted that the ladder boot comprises a large flat heavy duty aluminum or steel base member 11 having centrally located upstanding flanges 12 thereon. Flanges 12 are preferably cut or stamped from the base member 11 and bent upwardly at right angles thereto, remaining attached at their base ends to member 11. Spacing between the two upstanding flanges 12 is such as to accept the thickness of a normal step ladder leg therebetween, e.g. ¾ inch to 1 inch. As shown in FIG. 1, the boot 10 is positioned each side of a leg of the step ladder and a bolt 14 is run through end flange and through a hole drilled in the ladder leg (shown in broken lines). The hole in the ladder leg must be of sufficient diameter to accept the hollow spacer tube 14. Bolt 13 also extends through spacer tube 14 and is free to rotate therein. A nut 15 for bolt 13 completes the boot assembly.

FIGS. 3 and 4 illustrate that boot 10 is free to pivot about spacer tube 14 to allow plate 11 to self-align to a support position for the ladder leg and to make full contact with the ground surface on which it rests.

Figure 8:
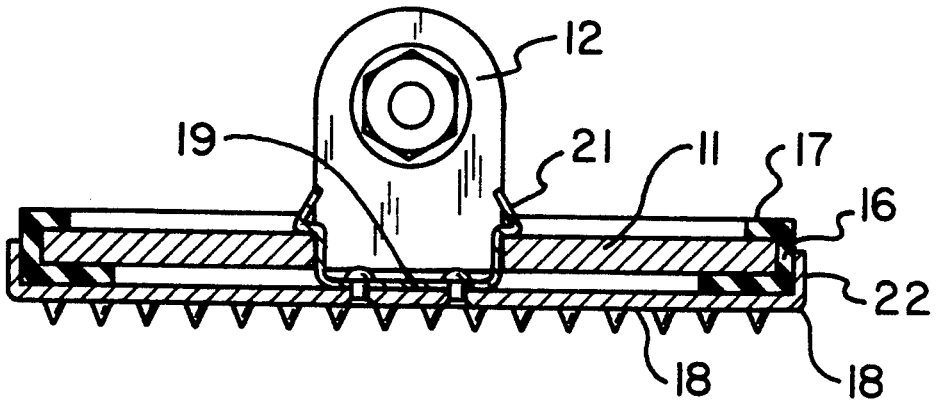
FIG. 8 is a sectional view on line 8—8 of FIG. 7.

FIGS. 5 and 6 illustrate a simple add-on for the unit 10 which will allow it to positively hold on slick, hard surfaces such as floors, sidewalks, or driveways, even when such surface is wet. This comprises a rubber or soft plastic elastomeric overboot 16 of the same dimension as plate 11 and having a lip 17 thereon to hold the overboot 16 in position when it is stretched and placed over plate 11. While overboot 16 may cover the entire base of plate 11, it is sufficient if it only extends a short distance around the inner periphery of the bottom of plate 11 as shown in FIG. 6.

Where the surface on which plate 11 is to be placed is slippery such as ice-coated, snow-covered or muddy, another type attachment may be applied to the base plate 11 of boot 10. In this instance, is shown in FIGS. 7 and 8, a tooth-studded metal pad 18 is added to cover the bottom of plate 11. This pad 18 has a pair of spring members 19 adapted to extend up through the openings 20 in plate 11 (from which flanges 12 were bent as described in connection with FIGS. 1 and 2). Each spring member 19 has a pair of spring clips 21 which will engage with the surface of plate 11 at each side of opening 20 to firmly lock pad 18 in place. The pad 18 also has vertical flanges 22 which engage with the side surfaces of plate 11. As shown in FIGS. 7 and 8, pad 18 may be used in conjunction with overboot 16 or obviously could be used by itself.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stabilizer system for step ladders which comprises: a set of four attachments, one for each leg of such step ladder; each attachment consisting of a large, flat, rigid base plate member; a pair of flange members stamped from the central section, of such base plate member, said flange members being cut free at the sides and one end thereof with the other end remaining attached to said base plate member and with the freed portion thereof bent up at right angles to said base plate member to define two upstanding flanges; said flanges being spaced one from the other to accept therebetween a leg of such step ladder pre-drilled to accept a bolt therethrough; a bolt hole in each of said flanges aligning with the hole in said step ladder leg; a spacer tube positioned between said flanges and rotatably accepting a bolt therein; and a bolt interconnecting said flanges and the pre-drilled leg of the step ladder to fasten the attachment thereto;

wherein each of said attachments includes a rigid, toothed pad extending across the bottom of said flat base member and secured thereto by spring clips extending through said base member in the portions thereof left open by the bending of said flanges.

* * * * *